US009689272B2

(12) United States Patent
Sakamoto et al.

(10) Patent No.: US 9,689,272 B2
(45) Date of Patent: Jun. 27, 2017

(54) GAS TURBINE AND OUTER SHROUD

(75) Inventors: Yasuro Sakamoto, Tokyo (JP); Eisaku Ito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 482 days.

(21) Appl. No.: 14/008,496

(22) PCT Filed: Mar. 6, 2012

(86) PCT No.: PCT/JP2012/055677
§ 371 (c)(1),
(2), (4) Date: Oct. 22, 2013

(87) PCT Pub. No.: WO2012/132787
PCT Pub. Date: Oct. 4, 2012

(65) Prior Publication Data

US 2014/0056690 A1 Feb. 27, 2014

(30) Foreign Application Priority Data

Mar. 30, 2011 (JP) ..... 2011-076830

(51) Int. Cl.
*F01D 9/04* (2006.01)
*F01D 5/14* (2006.01)
*F01D 11/08* (2006.01)

(52) U.S. Cl.
CPC ..... *F01D 9/045* (2013.01); *F01D 5/143* (2013.01); *F01D 11/08* (2013.01)

(58) Field of Classification Search
CPC ..... F01D 11/005; F01D 11/10; F01D 9/00; F01D 9/02; F01D 9/04; F01D 25/24; F01D 5/143
(Continued)

(56) References Cited

U.S. PATENT DOCUMENTS 2,735,612 A * 2/1956 Hausmann ..... F01D 5/143 138/111
4,317,646 A 3/1982 Steel et al.
(Continued)

FOREIGN PATENT DOCUMENTS

CN 1191930 A 9/1998
EP 2003292 A2 12/2008
(Continued)

OTHER PUBLICATIONS

International Search Report dated Apr. 10, 2012, issued in corresponding application PCT/JP2012/055677.
(Continued)

*Primary Examiner* — Richard Edgar
(74) *Attorney, Agent, or Firm* — Westerman, Hattori, Daniels & Adrian, LLP

(57) ABSTRACT

A gas turbine includes a turbine blade, a turbine vane, a ring segment circumferentially surrounding the turbine blade, an outer shroud circumferentially surrounding the turbine vane, and a combustion gas flow-path provided in the ring segment and the outer shroud. The outer shroud is positioned on an upstream side of the ring segment in a gas flow direction of the combustion gas. Seal gas, of which temperature is lower than that of the combustion gas, is fed between the ring segment- and the outer shroud into the combustion gas flow-path. The outer shroud has a guide surface that is provided on an inner circumference thereof on a downstream side of the gas flow direction. The guide surface is formed such that a flow passage area of the combustion gas flow-path is gradually increased.

15 Claims, 5 Drawing Sheets

(58) Field of Classification Search
USPC ..... 415/191, 168.1, 168.4; 416/193 A
See application file for complete search history.

(56) References Cited

U.S. PATENT DOCUMENTS

| | | | | |
|---|---|---|---|---|
| 4,596,116 | A | 6/1986 | Mandet et al. | |
| 4,650,394 | A | 3/1987 | Weidner | |
| 5,343,694 | A | 9/1994 | Toborg et al. | |
| 5,374,161 | A | 12/1994 | Kelch et al. | |
| 5,791,837 | A | 8/1998 | Johnson | |
| 6,126,394 | A * | 10/2000 | Matsuda | F01D 5/142 415/192 |
| 7,179,049 | B2 * | 2/2007 | Glasspoole | F01D 5/143 415/191 |
| 7,604,453 | B2 * | 10/2009 | Lee | F01D 5/143 415/1 |
| 2005/0106025 | A1 | 5/2005 | Snook et al. | |
| 2006/0219334 | A1 | 10/2006 | Brodt et al. | |
| 2008/0127491 | A1 | 6/2008 | Lee et al. | |
| 2008/0310961 | A1 | 12/2008 | Guemmer | |

FOREIGN PATENT DOCUMENTS

| | | | |
|---|---|---|---|
| JP | 59-153903 | A | 9/1984 |
| JP | 6-76764 | B2 | 9/1994 |
| JP | 6-105049 | B2 | 12/1994 |
| JP | 10-184304 | A | 7/1998 |
| JP | 2001-221065 | A | 8/2001 |
| JP | 3607331 | B2 | 1/2005 |
| JP | 2006-138259 | A | 6/2006 |
| JP | 3883245 | B2 | 2/2007 |
| JP | 2008-138666 | A | 6/2008 |
| JP | 2008-138667 | A | 6/2008 |

OTHER PUBLICATIONS

Chinese Office Action dated Oct. 10, 2014, issued in corresponding Chinese Application No. 201280015510.5; w/ English Translation. (25 pages).

Extended European Search Report dated Jul. 29, 2014, issued in corresponding European Patent Application No. 12765692.4 (6 pages).

Notification on the Grant of Patent Right for Invention dated Nov. 5, 2015, issued in counterpart Chinese application No. 201280015510.5, with English translation. (4 pages).

English translation of Written Opinion dated Apr. 10, 2012, issued in corresponding International Application No. PCT/JP2012/055677.

Korean Office Action dated Oct. 13, 2016, issued in counterpart Korean Patent Applcation No. 10-2013-7025504; w/English Translation. (13 pages).

Office Action dated Feb. 2, 2017, issued in counterpart Korean Application No. 10-2013-7025504, with English translation (3 pages).

* cited by examiner

GAS TURBINE AND OUTER SHROUD

FIELD

The present invention relates to a gas turbine that is rotated by combustion gas and an outer shroud.

BACKGROUND

Heretofore, a gas turbine has been known that is provided with an axis of rotation, turbine blades extending radially outwardly with respect to the axis of rotation, seal segments, each one of which provided spaced radially outwardly from each of the turbine blades, and stator assemblies that is adjacent to the seal segment (see e.g. Patent Literature 1). Each stator assembly and each seal segment are located spaced from one another and a cavity that circumferentially extends is formed between the stator assembly and the seal segment. The cavity forms a cooling air flow path.

CITATION LIST

Patent Literature

Patent Literature 1: Japanese Laid-open Patent Publication No. 7-233735

SUMMARY

Technical Problem

In the structure of a conventional gas turbine, it has been preferable that the inner circumferential surface of an outer shroud that defines a flow-path of a working fluid in the stator assembly positioned on the upstream side of the flow direction of the working fluid (FIG. 1, left) and a sealing surface of the seal segment positioned on the downstream side (FIG. 1, center) are formed such that heights thereof in a radial direction are flush with each other. However, in consideration of pressure loss in the flow direction of the working fluid, and thermal elongation, dimension tolerance, or the like of the seal segment, the sealing surface of the seal segment can be positioned slightly radially outwardly with respect to the inner circumferential surface of the outer shroud. In other words, an inner diameter of the seal segment can be larger as compared to an inner diameter of the outer shroud in the stator assembly.

In this case, a stepped portion is formed between the inner circumferential surface of the outer shroud and the sealing surface of the seal segment. However, when the stepped portion is formed, the working fluid flowing in the outer shroud and the seal segment forms vortexes on the downstream side of the stepped portion, and is prone to be mixed with seal gas supplied from the cavity. If the working fluid and the seal gas are mixed together, a temperature of the seal gas increases, which might lead to increase a heat load on the seal segment.

An object of the present invention is therefore to provide a gas turbine and an outer shroud capable of suppressing an increase in a heat load on ring segments (seal segments).

Solution to Problem

According to an aspect of the present invention, there is provided a gas turbine including: a turbine blade mounted to a rotatable turbine shaft; a turbine vane secured so as to be axially opposite with respect to the turbine blade; a ring segment circumferentially surrounding the turbine blade; an outer shroud circumferentially surrounding the turbine vane, the outer shroud being provided so as to be axially opposite with respect to the ring segment; and a combustion gas flow-path provided in the ring segment and the outer shroud, for passing combustion gas, wherein the outer shroud is positioned on an upstream side of the ring segment in a gas flow direction of the combustion gas, seal gas having a temperature lower than a temperature of the combustion gas is fed between the ring segment and the outer shroud into the combustion gas flow-path, the outer shroud has a guide surface that is provided on an inner circumference thereof on a downstream side of the gas flow direction, the guide surface that guides the combustion gas passing therein toward an inner circumferential surface of the ring segment, and the guide surface is formed such that a flow passage area of the combustion gas flow-path is gradually increased.

According to another aspect of the present invention, there is provided an outer shroud for circumferentially surrounding a turbine vane, the outer shroud being provided so as to be axially opposite with respect to a ring segment and the turbine vane being secured so as to be opposite with respect to a turbine blade in an axial direction of a rotatable turbine shaft, the outer shroud including: a combustion gas flow-path provided in the ring segment and the outer shroud, for passing combustion gas, wherein seal gas having a temperature lower than a temperature of the combustion gas is fed between the ring segment and the outer shroud into the combustion gas flow-path, the outer shroud has a guide surface that is provided on an inner circumference thereof on a downstream side of the gas flow direction, the guide surface that guides the combustion gas passing therein toward an inner circumferential surface of the ring segment, and the guide surface is formed such that a flow passage area of the combustion gas flow-path is gradually increased.

According to this configuration, the combustion gas flowing in the combustion gas flow-path in the outer shroud can be guided by the guide surface toward the inner circumferential surface of the ring segment. At this time, since the flow passage area of the combustion gas flow-path is formed to be gradually increased, it is possible to inhibit mixing of the combustion gas with the seal gas fed between the ring segment and the outer shroud, and to guide the seal gas along the inner circumferential surface of the ring segment. This allows cooling of the ring segment by seal gas, thereby suppressing an increase in a heat load on the ring segment.

In this case, it is preferable that a downstream end portion of the guide surface is positioned radially outwardly with respect to an inner circumferential surface of the outer shroud on an upstream side of the guide surface.

Similarly, it is preferable that the outer shroud further includes: an inner circumferential surface provided upstream of the guide surface, wherein a downstream end portion of the guide surface is positioned radially outwardly with respect to the inner circumferential surface.

According to this configuration, since the guide surface is extended radially outwardly when moving in the downstream direction, it is possible that the combustion gas is guided toward the inner circumferential surface of the ring segment, while being diffused radially outwardly toward the downstream side. This allows the suppression of a pressure loss in the combustion gas flowing from the outer shroud into the ring segment.

In this case, it is preferable that an upstream end portion of the inner circumferential surface of the ring segment is positioned radially outwardly with respect to a tangent on the downstream end portion of the guide surface.

Similarly, it is preferable that a tangent on the downstream end portion of the guide surface is positioned radially inwardly an upstream end portion of an inner circumferential surface of the ring segment.

According to this configuration, the combustion gas guided by the guide surface can preferably be guided toward the inner circumferential surface of the ring segment.

In this case, it is preferable that the guide surface is formed by notching the inner circumference of the outer shroud on the downstream side.

Similarly, it is preferable that the guide surface is formed by notching the inner circumference of the outer shroud on the downstream side.

According to this configuration, the guide surface can readily be formed by notching the inner circumference of the outer shroud.

In this case, it is preferable that the guide surface is formed at a projecting portion provided by projecting with respect to the inner circumference of the outer shroud on the downstream side.

Similarly, it is preferable that the guide surface is formed at a projecting portion provided by projecting with respect to the inner circumference of the outer shroud on the downstream side.

According to this configuration, the guide surface can be formed by providing the projecting portion on the inner circumference of the outer shroud.

In this case, it is preferable that the guide surface is formed at a curved surface.

According to this configuration, since the combustion gas can be guided along the guide surface that is a curved surface, it is possible to facilitate passage of the combustion gas, thereby reducing a heat load on the guide surface.

In this case, it is preferable that an angle of the tangent on the downstream end portion of the guide surface with respect to an axial direction of the turbine shaft is ranged from 10° or larger to 30° or smaller.

According to this configuration, the combustion gas flowing along the guide surface can preferably be guided toward the inner circumferential surface of the ring segment.

Advantageous Effects of Invention

According to a gas turbine and an outer shroud of the present invention, by providing a guide surface on an inner circumference of an outer shroud on the downstream side of a gas flow direction, mixing of combustion gas with seal gas is inhibited, thereby suppressing an increase in a heat load on a ring segment.

DESCRIPTION OF EMBODIMENTS

Hereinafter, a gas turbine according to the present invention will be described with reference to the accompanying drawings. It should be noted that the present invention is not limited to the below described embodiments. Further, constituent elements in the embodiments below include those that can be replaced and easily made by persons skilled in the art, or that are substantially equivalent.

First Embodiment

Figure 1:
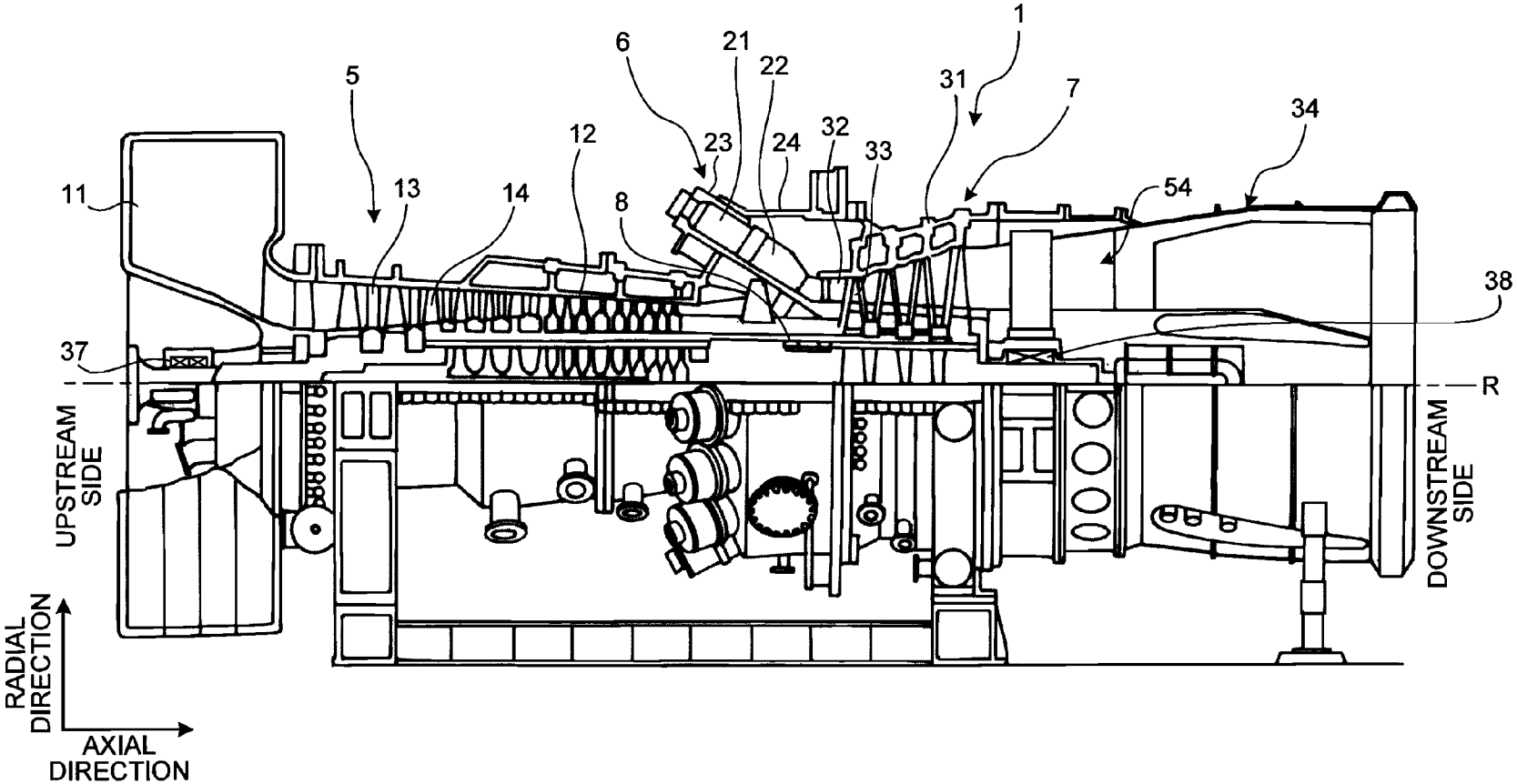
FIG. 1 is a schematic configuration view of a gas turbine according to the first embodiment.

As illustrated in FIG. 1, a gas turbine 1 of the first embodiment is constituted of a compressor 5, a combustor 6, and a turbine 7. Further, a turbine shaft 8 is disposed to pass through the center portion of the compressor 5, the combustor 6, and the turbine 7. The compressor 5, the combustor 6, and the turbine 7 are arranged in a row and in this order from the upstream side to the downstream side of a gas flow direction of air or combustion gas along an axial center R of the turbine shaft 8.

The compressor 5 compresses air, so that the air is turned into compressed air. The compressor 5 is provided with a compressor casing 12 having an air inlet port 11 for taking air therein, the compressor casing 12, in which a plurality of stages of compressor vanes 13 and a plurality of stages of compressor blades 14 are arranged. The compressor vane 13 of each one of the plurality of stages is mounted to the compressor casing 12, and circumferentially arranged in a row in a plurality of places. The compressor blade 14 of each one of the plurality of stages is mounted to the turbine shaft 8, and circumferentially arranged in a row in a plurality of places. The plurality of stages of compressor vanes 13 and the plurality of stages of the compressor blades 14 are alternately arranged along the axial direction.

The combustor 6 supplies fuel to compressed air compressed by the compressor 5, so that high-temperature and high-pressure combustion gas is generated. The combustor 6 has an inner cylinder 21 that serves as a combustion chamber for mixing and burning the compressed air and the fuel, a transition piece 22 for introducing the combustion gas from the inner cylinder 21 to the turbine 7, and an external cylinder 23 for covering the outer circumference of the inner cylinder 21 and introducing the compressed air from the compressor 5 to the inner cylinder 21. The combustor 6 is arranged in a row in a plurality of places circumferentially with respect to a combustor casing 24.

The turbine 7 generates rotational power using the combustion gas burned in the combustor 6. The turbine 7 has a turbine casing 31 that defines an outer shell, and in the turbine casing 31, a plurality of stages of turbine vanes 32, and a plurality of stages of turbine blades 33 are provided. The turbine vane 32 of each one of the plurality of stages is mounted to the turbine casing 31, and circumferentially arranged in a row in a plurality of places. The turbine blade 33 of each one of the plurality of stages is secured to the outer circumference of a discus-like disk centered on the axial center R of the turbine shaft 8, and circumferentially arranged in a row in a plurality of places. The plurality of stages of turbine vanes 32 and the plurality of stages of turbine blades 33 are alternately arranged in a plurality of places along the axial direction. The turbine 7 will now be specifically described with reference to FIG. 2.

Figure 2:
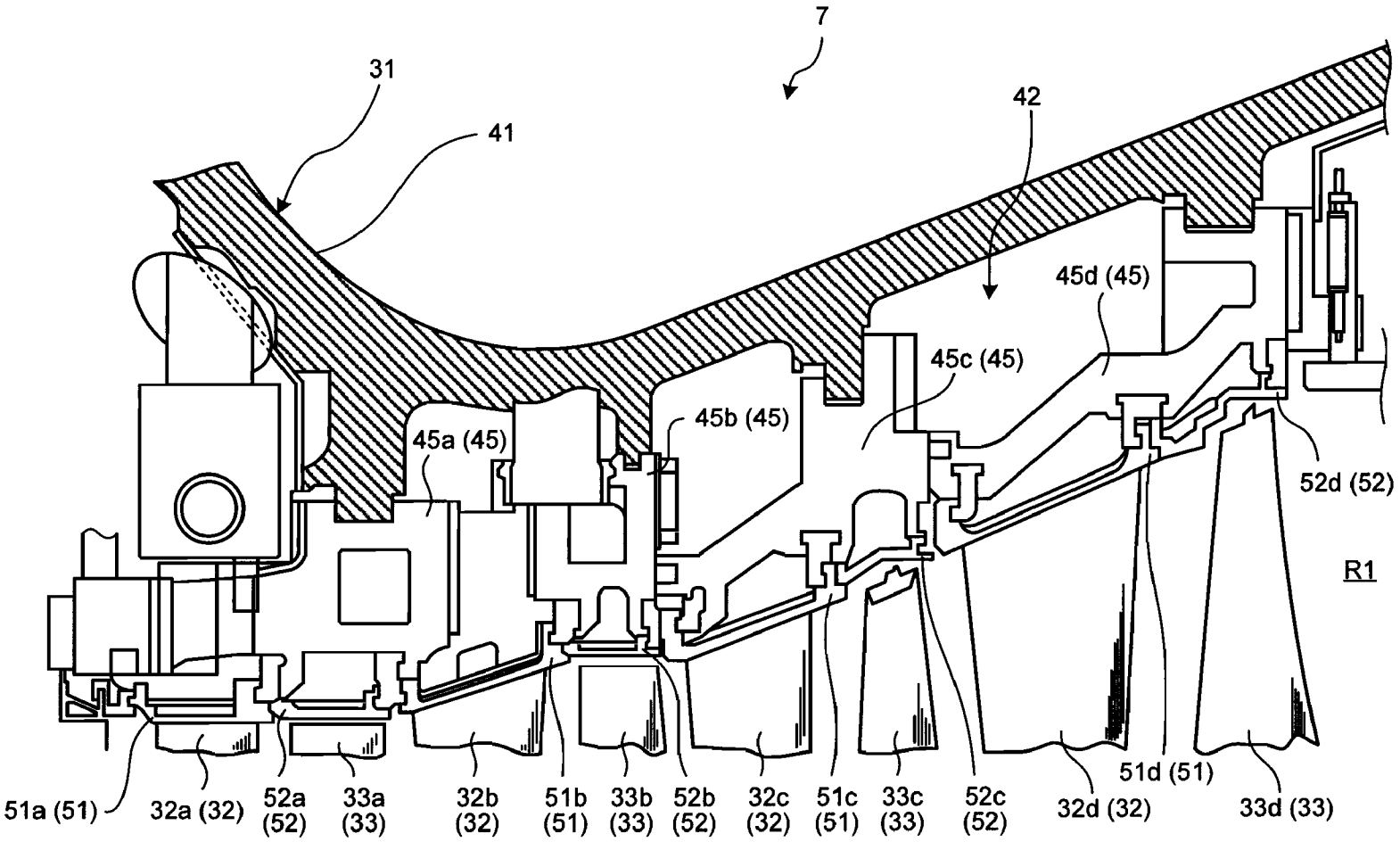
FIG. 2 is a partial sectional view around a turbine of the gas turbine according to the first embodiment.

As illustrated in FIG. 2, the turbine casing 31 has an outer casing 41 and an inner casing 42. In addition, on the downstream side of the turbine casing 31, there is provided a flue gas chamber 34 that has a diffuser 54 therein, the diffuser 54 communicating with the turbine 7 (see FIG. 1). The inner casing 42 has a plurality of diaphragms 45 axially arranged in a row. The plurality of diaphragms 45 includes a first diaphragm 45*a*, a second diaphragm 45*b*, a third diaphragm 45*c*, and a fourth diaphragm 45*d* in this order from the upstream side of the gas flow direction (axial direction). The plurality of diaphragms 45 is disposed radially inwardly of the outer casing 41.

The inner casing 42 is provided with a plurality of outer shrouds 51 and a plurality of ring segments 52. The plurality of outer shrouds 51 includes a first outer shroud 51*a*, a second outer shroud 51*b*, a third outer shroud 51*c*, and a fourth outer shroud 51*d* in this order from the upstream side of the gas flow direction. Further, the plurality of ring segments 52 includes a first ring segment 52*a*, a second ring segment 52*b*, a third ring segment 52*c*, and a fourth ring segment 52*d* in this order from the upstream side of the gas flow direction.

The plurality of outer shrouds 51 and the plurality of ring segments 52 are provided such that the first outer shroud 51*a*, the first ring segment 52*a*, the second outer shroud 51*b*, the second ring segment 52*b*, the third outer shroud 51*c*, the third ring segment 52*c*, the fourth outer shroud 51*d*, and the fourth ring segment 52*d* are arranged in this order from the upstream side of the gas flow direction, and such that each one of the outer shrouds and the ring segments are axially oppositely disposed.

The first outer shroud 51*a* and the first ring segment 52*a* are mounted radially inwardly of the first diaphragm 45*a*. Similarly, the second outer shroud 51*b* and the second ring segment 52*b* are mounted on radially inwardly of the second diaphragm 45*b*, the third outer shroud 51*c* and the third ring segment 52*c* are mounted on radially inwardly of the third diaphragm 45*c*, and the fourth outer shroud 51*d* and the fourth ring segment 52*d* are mounted radially inwardly of the fourth diaphragm 45*d*.

An annular flow-path formed between the inner circumferential side of the plurality of outer shrouds 51 and of the plurality of the ring segments 52, and the outer circumferential side of the turbine shaft 8 constitutes a combustion gas flow-path R1. The combustion gas flows along the combustion gas flow-path R1.

The plurality of stages of turbine vanes 32 is disposed in accordance with each of the plurality of outer shrouds 51, and is provided radially inwardly of the plurality of outer shrouds 51. The turbine vane 32 of each one of the plurality of stages is provided to be integral with each outer shroud 51, and constitutes a stationary side. The plurality of stages of turbine vanes 32 includes a first turbine vane 32*a*, a second turbine vane 32*b*, a third turbine vane 32*c*, and a fourth turbine vane 32*d* in this order from the upstream side of the gas flow direction. The first turbine vane 32*a* is provided radially inwardly of the first outer shroud 51*a*. Similarly, the second turbine vane 32*b*, the third turbine vane 32*c*, and the fourth turbine vane 32*d* are provided radially inwardly of the second outer shroud 51*b*, the third outer shroud 51*c*, and the fourth outer shroud 51*d*, respectively.

The plurality of stages of turbine blades 33 is disposed in accordance with each of the plurality of ring segments 52, and is provided radially inwardly of the plurality of ring segments 52. The turbine blade 33 of each one of the plurality of stages is provided spaced with respect to each ring segment 52, and constitutes a movable side. The plurality of stages of turbine blades 33 includes a first turbine blade 33*a*, a second turbine blade 33*b*, a third turbine blade 33*c*, and a fourth turbine blade 33*d* in this order from the upstream side of the gas flow direction. Further, the first turbine blade 33*a* is provided radially inwardly of the first ring segment 52*a*. Similarly, the second turbine blade 33*b*, the third turbine blade 33*c*, and the fourth turbine blade 33*d* are provided radially inwardly of the second ring segment 52*b*, the third ring segment 52*c*, and the fourth ring segment 52*d*, respectively.

With this arrangement, the plurality of stages of turbine vanes 32 and the plurality of stages of turbine blades 33 are provided such that the first turbine vane 32*a*, the first turbine blade 33*a*, the second turbine vane 32*b*, the second turbine blade 33*b*, the third turbine vane 32*c*, the third turbine blade 33*c*, the fourth turbine vane 32*d*, and the fourth turbine blade 33*d* are arranged in this order from the upstream side of the gas flow direction, and such that each one of the turbine vanes and the turbine blades are axially oppositely disposed.

The turbine shaft 8 is provided rotatably about the axial center R by having one end portion thereof near the compressor 5 supported by a bearing 37, and having another end portion thereof near the flue gas chamber 34 supported by a bearing 38. Further, a drive shaft of a power generator (not illustrated) is coupled to the end portion of the turbine shaft 8 near the flue gas chamber 34.

In the gas turbine 1 as described above, when the turbine shaft 8 is rotated, air is taken in from the air inlet port 11 of the compressor 5. Then, the air taken in passes through the plurality of stages of compressor vanes 13 and the plurality of stages of compressor blades 14, and is compressed to be high-temperature and high-pressure compressed air. The combustor 6 supplies fuel to this compressed air to generate high-temperature and high-pressure combustion gas. This combustion gas passes through the plurality of stages of turbine vanes 32 and the plurality of stages of turbine blades 33 in the turbine 7, and rotationally drives the turbine shaft 8. Accordingly, the power generator coupled to the turbine shaft 8 is provided with rotational power, and generates electric power. Subsequently, the combustion gas after rotationally driving the turbine shaft 8 is converted to static pressure in the diffuser 54 in the flue gas chamber 34, and then is discharged to the air.

Figure 3:
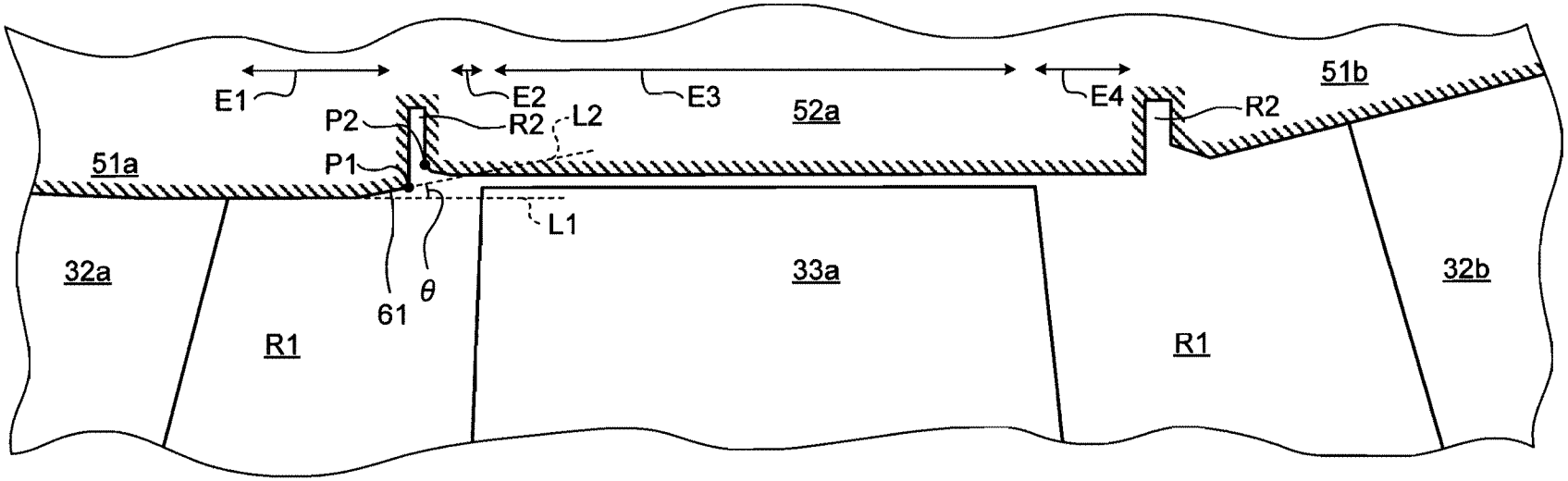
FIG. 3 is a schematic view around a first turbine blade of the gas turbine according to the first embodiment.

Next, the configuration around the first turbine blade 33*a* of the turbine 7 will be described with reference to FIG. 3. FIG. 3 is a schematic view around the first turbine blade of the gas turbine according to the first embodiment. Between each one of the outer shrouds 51 and the each one of the ring segments 52, a cavity R2 is individually provided. The cavity R2 is provided over the circumferential direction. Seal gas such as air, of which temperature is lower than that of the combustion gas, is supplied from the cavity R2 toward the combustion gas flow-path R1.

As illustrated in FIG. 3, in consideration of the pressure loss in the gas flow direction of the combustion gas, and the thermal elongation, dimension tolerance, or the like of the ring segment 52, the inner diameter of the first ring segment 52*a* is slightly larger as compared to the inner diameter of the first outer shroud 51*a*. The configuration around the cavity R2 located between the first outer shroud 51*a* and the first ring segment 52*a* will now be described.

The first outer shroud 51*a* has a guide surface 61 that is formed on the inner circumferential surface on the downstream side. The guide surface 61 is formed by notching the inner circumferential surface of the first outer shroud 51*a* on the downstream side, and is formed such that the combustion gas flowing along the guide surface 61 is directed to the inner circumferential surface of the first ring segment 52*a*. The combustion gas flow-path R1 on the guide surface 61 of the first outer shroud 51*a* is thus formed such that the flow passage area thereof is gradually increased.

The guide surface 61 is an inclined surface having a linear form in cross section and being inclined radially outwardly from the upstream side to the downstream side of the gas flow direction. A downstream end portion P1 of the guide surface 61 is positioned radially outwardly with respect to an extended line L1 of the inner circumferential surface of the first outer shroud 51*a* on the upstream side of the guide surface 61. The extending direction of the extended line L1 is the same direction as the axial direction of the turbine shaft 8. In addition, the angle θ formed between the extended line L1 that is the same direction as the axial direction of the turbine shaft and the tangent L2 on the downstream end portion P1 of the guide surface 61 is ranged from 10° or larger to 30° or smaller. Further, an upstream end portion P2 on the inner circumferential surface of the first ring segment 52*a* is positioned radially outwardly with respect to the tangent L2. In other words, the tangent L2 is positioned radially inwardly with respect to upstream end portion P2 on the inner circumferential surface of the first ring segment 52*a*.

Therefore, when the combustion gas flowing along the inner circumferential surface of the first outer shroud 51*a* reaches the guide surface 61, the combustion gas flows along the guide surface 61. Accordingly, a portion of the combustion gas spreads and flows radially outwardly, and flows toward the inner circumferential surface of the first ring segment 52*a*. On the other hand, the seal gas supplied from the cavity R2 that is located between the first outer shroud 51*a* and the first ring segment 52*a* flows toward the combustion gas flow-path R1. The seal gas flown into the combustion gas flow-path R1 is introduced by the flow of the combustion gas, thereby flowing toward the inner circumferential surface of the first ring segment 52*a*. Accordingly, the seal gas flows along the inner circumferential surface of the first ring segment 52*a* without being mixed with the combustion gas, and the combustion gas flows along the seal gas that flows along the inner circumferential surface of the first ring segment 52*a*. In other words, the seal gas that flows along the inner circumferential surface of the first ring segment 52*a* and the combustion gas that flows along the seal gas flow in layers.

Figure 4:
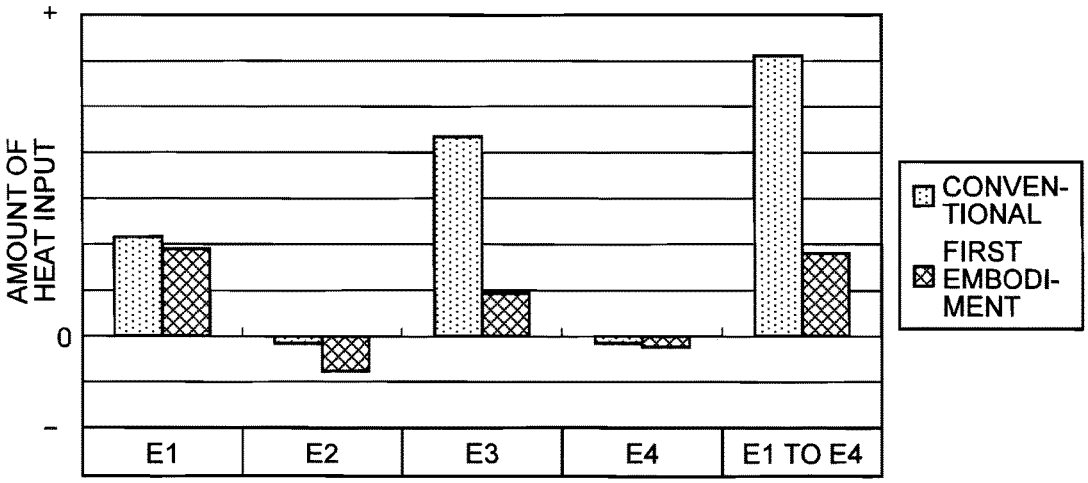
FIG. 4 is a graph comparing the amount of heat input around a first ring segment of the gas turbine according to the first embodiment to the amount of heat input around the first ring segment of a conventional gas turbine.

Next, with reference to FIG. 4, the amount of heat input around the first ring segment of the gas turbine according to the first embodiment and the amount of heat input around the first ring segment of a conventional gas turbine will be compared. FIG. 4 is a graph comparing the amount of heat input around the first ring segment of the gas turbine according to the first embodiment to the amount of heat input around the first ring segment of the conventional gas turbine. In the graph illustrated in FIG. 4, the vertical axis thereof indicates amounts of heat input, and the amounts of heat input are the results of the analysis performed in a plurality of areas.

As illustrated in FIG. 3, the plurality of areas includes a first area E1, a second area E2, a third area E3, and a fourth area E4 in this order from the upstream side of the gas flow direction. The first area E1 is an area on the inner circumferential surface of the first outer shroud 51*a* on the downstream side of the first turbine vane 32*a*. The second area E2 is an area on the inner circumferential surface of the first ring segment 52*a* on the upstream side of the first turbine blade 33*a*. The third area E3 is an area on the inner circumferential surface of the first ring segment 52*a* where the first turbine blade 33*a* is located. The fourth area E4 is an area on the inner circumferential surface of the first ring segment 52*a* on the downstream side of the first turbine blade 33*a*.

It should be noted that a comparative conventional configuration is a configuration, in which the guide surface 61 formed by notching is not provided. That is, in the conventional first outer shroud 51*a*, the inner circumferential surface thereof is plane over the surface from the upstream side to the downstream side of the gas flow direction.

Here, the amount of heat input in the first area E1 is slightly reduced as compared to the conventional configuration by an amount of the guide surface 61 formed. As regards the amount of heat input in the second area E2, by forming the guide surface 61, mixing of the seal gas supplied from the cavity R2 with the combustion gas is inhibited, thereby improving heat-removal effects as compared to the conventional configuration. The amount of heat input in the third area E3 is considerably reduced as compared to the conventional configuration because mixing of the seal gas with the combustion gas is inhibited, and the seal gas and the combustion gas flow in layers. As regards the amount of heat input in the fourth area E4, no remarkable difference is observed between the configuration of the first embodiment and the conventional configuration. Further, it has been determined that total amount of heat input in the first area E1 to the fourth area E4 in the configuration of the first embodiment can be reduced as compared to the conventional configuration, and that a heat load on the first ring segment 52*a* can be suppressed.

As described above, according to the configuration of the first embodiment, in the first outer shroud 51*a*, the combustion gas flowing in the combustion gas flow-path R1 can be guided by the guide surface 61 toward the inner circumferential surface of the first ring segment 52*a*. At this time, since the guide surface 61 is formed such that the flow passage area of the combustion gas flow-path R1 is gradually increased, it is possible to inhibit mixing of the combustion gas with the seal gas supplied from the cavity R2, and to guide the seal gas along the inner circumferential surface of the first ring segment 52*a*. Accordingly, mixing of the combustion gas with the seal gas is inhibited, and the first ring segment 52*a* can be cooled by the seal gas, of which temperature is lower than that of the combustion gas, thereby suppressing an increase in a heat load on the first ring segment 52*a*.

Further, according to the configuration of the first embodiment, since the angle θ of the tangent L2 with respect to the extended line L1 can be ranged from 10° or larger to 30° or smaller, it is possible to preferably guide the combustion gas flowing along the guide surface 61 toward the inner circumferential surface of the first ring segment 52*a*.

It should be noted that although the guide surface 61 is provided on the inner circumferential surface of the first outer shroud 51*a* in the first embodiment, it is not limited thereto, and the guide surface 61 may be provided on the inner circumferential surface of other one of the outer shrouds 51.

Also, although the guide surface 61 is an inclined surface having a linear form in cross section in the first embodiment, it is not limited thereto, and the guide surface 61 may be a curved surface having a curved form in cross section. According to this configuration, since the combustion gas can be guided along the guide surface that is a curved surface, it is possible to facilitate passage of combustion gas, and to reduce a heat load on the guide surface 61.

Second Embodiment

Figure 5:
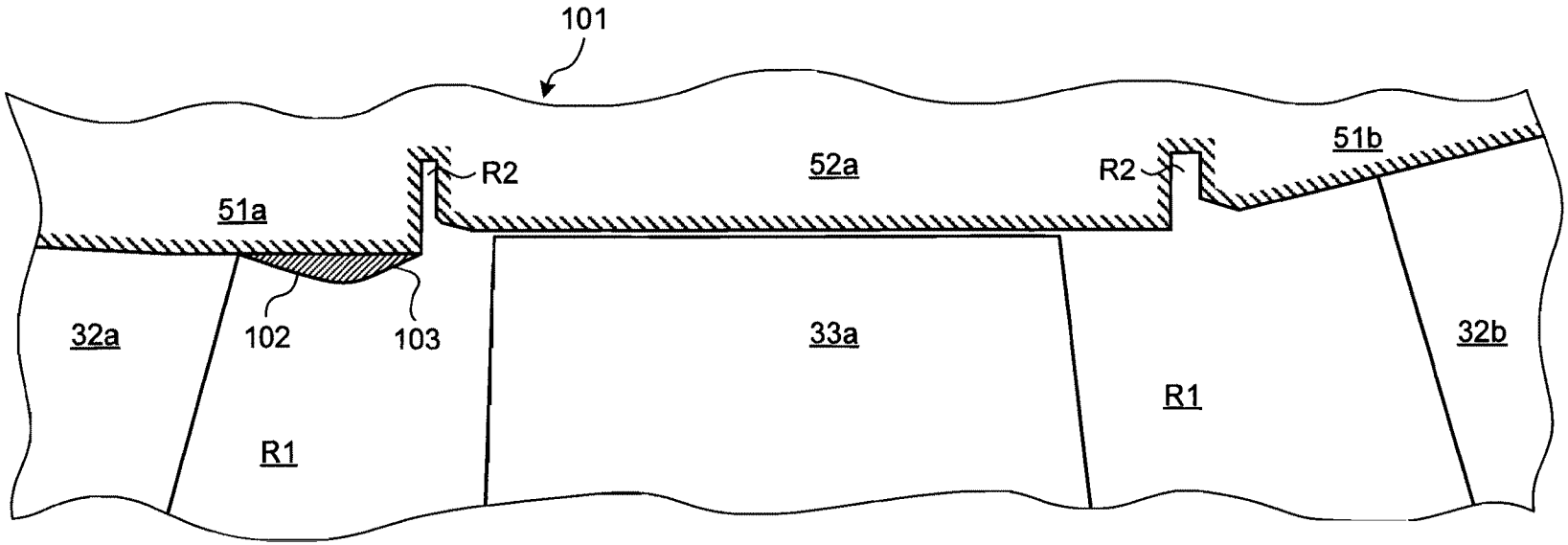
FIG. 5 is a schematic view around a first turbine blade of a gas turbine according to the second embodiment.

Next, a gas turbine according to a second embodiment will be described with reference to FIG. 5. FIG. 5 is a schematic view around the first turbine blade of a gas turbine according to the second embodiment. In the second embodiment, in order to avoid redundant description, only different parts will be described. In the gas turbine 1 of the first embodiment, the guide surface 61 is formed by notching the inner circumferential surface of the first outer shroud 51*a*. However, in a gas turbine 101 of the second embodiment, a guide surface 103 is formed by providing a projecting portion 102 on the inner circumferential surface of the first outer shroud 51*a*. The projecting portion 102 that is provided on the inner circumferential surface of the first outer shroud 51*a* will now be described with reference to FIG. 5.

The projecting portion 102 is provided on the inner circumferential surface of the first outer shroud 51*a* on the downstream side of the first turbine vane 32*a*. The projecting portion 102 is formed to be a curved surface projecting radially inwardly therefrom. On a portion of the upstream side thereof, there is formed an inclined surface having a linear form in cross section or a curved form in cross section inclining in a radially inward direction, and on a portion of the downstream side thereof, there is formed the guide surface 103 having a linear form in cross section or a curved form in cross section inclining in a radially outward direction.

Consequently, when the combustion gas flowing along the inner circumferential surface of the first outer shroud 51*a* reaches the guide surface 103 of the projecting portion 102, the combustion gas flows along the guide surface 103. Accordingly, a portion of the combustion gas spreads and flows radially outwardly, and flows toward the inner circumferential surface of the first ring segment 52*a*. On the other hand, the seal gas supplied from the cavity R2 that is located between the first outer shroud 51*a* and the first ring segment 52*a* flows toward the combustion gas flow-path R1. The seal gas flown into the combustion gas flow-path R1 is introduced by the flow of the combustion gas, thereby flowing toward the inner circumferential surface of the first ring segment 52*a*. Accordingly, mixing of the seal gas with the combustion gas is inhibited, and the seal gas flows along the inner circumferential surface of the first ring segment 52*a*. The combustion gas flows along the seal gas that flows along the inner circumferential surface of the first ring segment 52*a*. In other words, the seal gas that flows along the inner circumferential surface of the first ring segment 52*a* and the combustion gas that flows along the seal gas flow in layers.

As described above, also in the configuration of the second embodiment, in the first outer shroud 51*a*, the combustion gas flowing in the combustion gas flow-path R1 can be guided by the guide surface 103 toward the inner circumferential surface of the first ring segment 52*a*. At this time, since the guide surface 103 is formed such that the flow passage area of the combustion gas flow-path R1 is gradually increased, it is possible to inhibit mixing of the combustion gas with the seal gas supplied from the cavity R2, and to guide the seal gas along the inner circumferential surface of the first ring segment 52*a*. Accordingly, mixing of the combustion gas with the seal gas is inhibited, and the first ring segment 52*a* can be cooled by the seal gas, of which temperature is lower than that of the combustion gas, thereby suppressing an increase in a heat load on the first ring segment 52*a*.

REFERENCE SIGNS LIST

1 GAS TURBINE
5 COMPRESSOR
6 COMBUSTOR
7 TURBINE
8 TURBINE SHAFT
11 AIR INLET PORT
12 COMPRESSOR CASING
13 COMPRESSOR VANE
14 COMPRESSOR BLADE
21 INNER CYLINDER
22 TRANSITION PIECE
23 EXTERNAL CYLINDER
24 COMBUSTOR CASING
31 TURBINE CASING
32 TURBINE VANE
33 TURBINE BLADE
41 OUTER CASING
42 INNER CASING
45 DIAPHRAGM
51 OUTER SHROUD
52 RING SEGMENT
61 GUIDE SURFACE
101 GAS TURBINE (SECOND EMBODIMENT)
102 PROJECTING PORTION
103 GUIDE SURFACE (SECOND EMBODIMENT)
R1 COMBUSTION GAS FLOW-PATH
R2 CAVITY

The invention claimed is:

1. A gas turbine comprising:

a plurality of turbine blades mounted to a rotatable turbine shaft;

a plurality of turbine vanes secured so as to be axially opposite with respect to the turbine blades;

a plurality of ring segments circumferentially surrounding the turbine blades, respectively;

a plurality of outer shrouds circumferentially surrounding the turbine vanes, respectively, the outer shrouds being provided so as to be axially opposite with respect to the ring segments; and a combustion gas flow-path provided in the ring segments and the outer shrouds, for passing combustion gas, wherein a first outer shroud of the plurality of outer shrouds is positioned on an upstream side of a first ring segment of the plurality of ring segments in a gas flow direction of the combustion gas, seal gas having a temperature lower than a temperature of the combustion gas is fed between the first ring segment and the first outer shroud into the combustion gas flow-path, an inner diameter of the first ring segment is larger than that of the first outer shroud, an outer diameter of a turbine blade surrounded by the first ring segment is larger than that of a turbine vane surrounded by the first outer shroud, the first outer shroud has a guide surface that is provided on an inner circumference thereof on a downstream side of the gas flow direction, and the guide surface guides the combustion gas passing therein toward an inner circumferential surface of the first ring segment, the guide surface changes a part of the combustion gas flowing toward the first ring segment, and the guide surface is formed such that a flow passage area of the combustion gas flow-path is gradually increased, the gas turbine has a plurality of areas including:

a first area being an area on an inner circumferential surface of the first outer shroud on a downstream side of the first turbine vane;

a second area being an area on an inner circumferential surface of the first ring segment on an upstream side of the first turbine blade;

a third area being an area on an inner circumferential surface of the first ring segment where the first turbine blade is located; and a fourth area being an area on an inner circumferential surface of the first ring segment on a downstream side of the first turbine blade, the guide surface is provided in the first area, an intersection point between a tangent of the guide surface and the inner circumferential surface of the first ring segment is positioned on the second area.

2. The gas turbine according to claim 1, wherein a downstream end portion of the guide surface is positioned radially outwardly with respect to an inner circumferential surface of the first outer shroud on an upstream side of the guide surface.

3. The gas turbine according to claim 1, wherein an upstream end portion of the inner circumferential surface of the first ring segment is positioned radially outwardly with respect to a tangent on the downstream end portion of the guide surface.

4. The gas turbine according to claim 1, wherein the guide surface is formed by notching the inner circumference of the first outer shroud on the downstream side.

5. The gas turbine according to claim 1, wherein the guide surface is formed at a projecting portion provided by projecting with respect to the inner circumference of the first outer shroud on the downstream side.

6. The gas turbine according to claim 1, wherein the guide surface is formed at a curved surface.

7. The gas turbine according to claim 1, wherein an angle of a tangent on a downstream end portion of the guide surface with respect to an axial direction of the turbine shaft is ranged from 10° or larger to 30° or smaller.

8. The gas turbine according to claim 1, wherein the guide surface does not include a convex surface.

9. A plurality of outer shrouds for circumferentially surrounding a plurality of turbine vanes, the outer shrouds being provided so as to be axially opposite with respect to a plurality of ring segments and the turbine vanes being secured so as to be opposite with respect to a plurality of turbine blades in an axial direction of a rotatable turbine shaft, the outer shrouds comprising:

a combustion gas flow-path provided in the ring segments and the outer shrouds, for passing combustion gas, wherein a first outer shroud of the plurality of outer shrouds is positioned on an upstream side of a first ring segment of the plurality of ring segments in a gas flow direction of the combustion gas, an inner diameter of the first ring segment is larger than that of the first outer shroud, an outer diameter of a turbine blade surrounded by the first ring segment is larger than that of a turbine vane surrounded by the first outer shroud, seal gas having a temperature lower than a temperature of the combustion gas is fed between the first ring segment and the first outer shroud into the combustion gas flow-path, the first outer shroud of the plurality of outer shrouds has a guide surface that is provided on an inner circumference thereof on a downstream side of the gas flow direction, and the guide surface guides the combustion gas passing therein toward an inner circumferential surface of the first ring segment, the guide surface changes a part of the combustion gas flowing toward the first ring segment, and the guide surface is formed such that a flow passage area of the combustion gas flow-path is gradually increased, among a first area being an area on an inner circumferential surface of the first outer shroud on a downstream side of the first turbine vane, a second area being an area on an inner circumferential surface of the first ring segment on an upstream side of the first turbine blade, a third area being an area on an inner circumferential surface of the first ring segment where the first turbine blade is located and a fourth area being an area on an inner circumferential surface of the first ring segment on a downstream side of the first turbine blade the guide surface is provided in the first area, an intersection point between a tangent of the guide surface and the inner circumferential surface of the first ring segment is positioned on the second area.

10. The plurality of outer shrouds according to claim 9, further comprising:

an inner circumferential surface provided upstream of the guide surface, wherein a downstream end portion of the guide surface is positioned radially outwardly with respect to the inner circumferential surface.

11. The plurality of outer shrouds according to claim 9, wherein a tangent on a downstream end portion of the guide surface is positioned radially inwardly an upstream end portion of an inner circumferential surface of the first ring segment.

12. The plurality of outer shrouds according to claim 9, wherein the guide surface is formed by notching the inner circumference of the first outer shroud on the downstream side.

13. The plurality of outer shrouds according to claim 9, wherein the guide surface is formed at a projecting portion provided by projecting with respect to the inner circumference of the first outer shroud on the downstream side.

14. The plurality of outer shrouds according to claim 9, wherein the guide surface is formed at a curved surface.

15. The plurality of outer shrouds according to claim 9, wherein an angle of a tangent on a downstream end portion of the guide surface with respect to an axial direction of the turbine shaft is ranged from 10° or larger to 30° or smaller.

* * * * *